US008375517B1

(12) United States Patent
Johnsen

(10) Patent No.: US 8,375,517 B1
(45) Date of Patent: Feb. 19, 2013

(54) HINGE INCORPORATING HORIZONTAL AND VERTICAL ADJUSTMENTS

(76) Inventor: Thore K. Johnsen, East Meadow, NY (US)

( * ) Notice: Subject to any disclaimer, the term of this patent is extended or adjusted under 35 U.S.C. 154(b) by 0 days.

(21) Appl. No.: 13/092,922

(22) Filed: Apr. 23, 2011

(51) Int. Cl.
*E05D 7/04* (2006.01)

(52) U.S. Cl. ..... 16/236; 16/244; 16/240; 16/86.1

(58) Field of Classification Search ..... 16/236, 16/243–246, 240, 252, 253, 238, 86.1, 86.2, 16/389, 387, 386; 49/381, 382; 256/21, 256/26, 54, DIG. 5
See application file for complete search history.

(56) References Cited

U.S. PATENT DOCUMENTS

| | | | | |
|---|---|---|---|---|
| 128,593 | A | 7/1872 | Cluff | |
| 442,547 | A | 12/1890 | Radler | |
| 527,685 | A | 10/1894 | Haege | |
| 1,563,869 | A * | 12/1925 | Larson | 16/243 |
| 2,373,955 | A | 4/1945 | Fuller | |
| 2,611,921 | A * | 9/1952 | Weidelstam | 16/244 |
| 2,618,010 | A * | 11/1952 | Helz | 16/244 |
| 3,514,807 | A * | 6/1970 | Triplett | 16/253 |
| 4,330,901 | A | 5/1982 | Sanders | |
| 4,381,580 | A * | 5/1983 | Hellstrom et al. | 16/243 |
| 4,748,717 | A * | 6/1988 | Osborne | 16/240 |
| 5,144,721 | A | 9/1992 | Schade | |
| 5,669,105 | A * | 9/1997 | Depke | 16/245 |
| 5,755,011 | A | 5/1998 | Green et al. | |
| 6,073,396 | A * | 6/2000 | Kietzmann | 49/381 |
| 6,212,734 | B1 * | 4/2001 | Commons | 16/244 |
| 6,725,504 | B1 | 4/2004 | Dickson et al. | |
| 6,802,106 | B2 * | 10/2004 | Taglianetti | 16/246 |
| 7,269,880 | B2 | 9/2007 | Wallis et al. | |
| 7,895,713 | B2 * | 3/2011 | Williams, Jr. | 16/387 |
| 2005/0120517 | A1 * | 6/2005 | Bonham | 16/238 |
| 2005/0183238 | A1 | 8/2005 | McCue et al. | |
| 2010/0077663 | A1 * | 4/2010 | Singleton | 49/70 |

FOREIGN PATENT DOCUMENTS

| | | | |
|---|---|---|---|
| DE | 29608273 | U1 * | 9/1996 |
| FR | 2538839 | A * | 7/1984 |
| FR | 2.786.806 | | 6/2000 |
| GB | 00813 | | 0/1911 |

* cited by examiner

*Primary Examiner* — Chuck Y. Mah
(74) *Attorney, Agent, or Firm* — Michael I. Kroll

(57) ABSTRACT

A hinge comprising door/gate horizontal and vertical displacement portions. The adjustment means is comprised of a threaded post for varying the distance between hinge portions in the vertical therein raising or lowering the attached door/gate and perpendicularly extending horizontal threaded post having re-positional door/gate abutment that can be used to change the tilt of the door/gate by varying the length difference of the abutments on the spaced apart hinges.

16 Claims, 8 Drawing Sheets

HINGE INCORPORATING HORIZONTAL AND VERTICAL ADJUSTMENTS

BACKGROUND OF THE INVENTION

1. Field of the Invention

Figure 1:
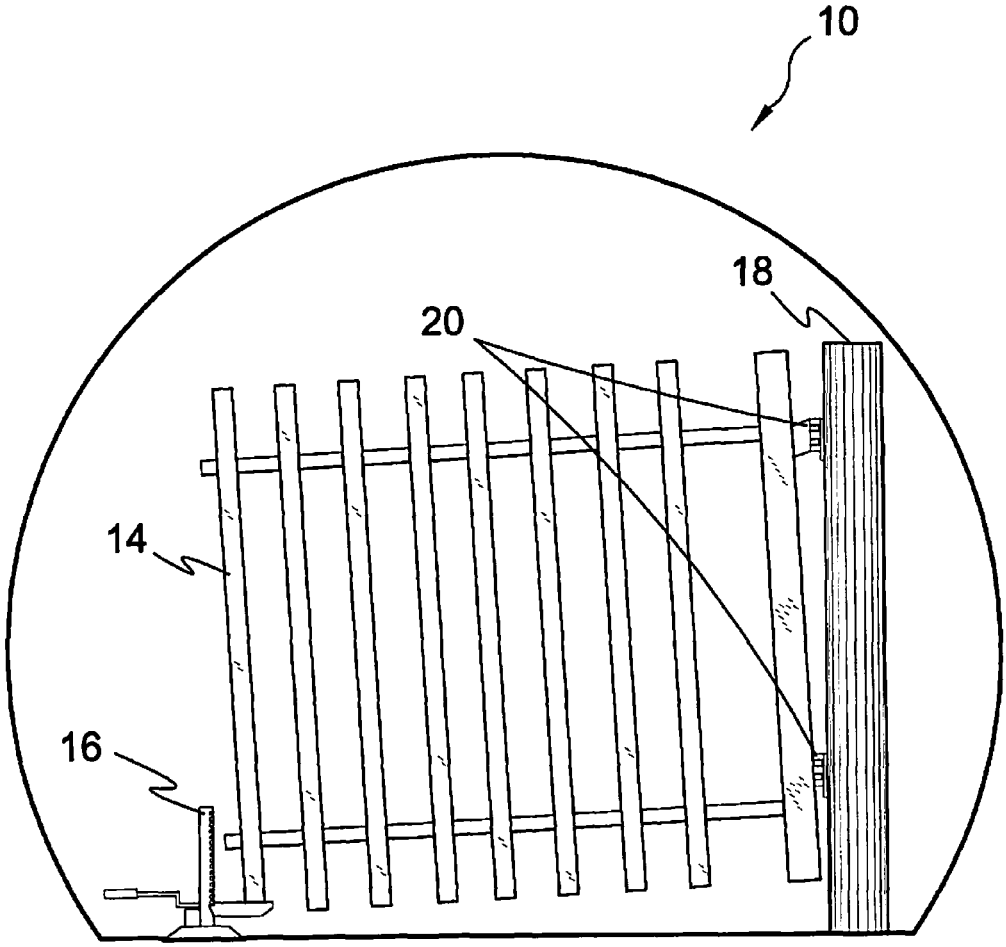
prior art FIG. 1

The present invention relates generally to hinges and, more specifically, to a hinge incorporating door/gate horizontal and vertical displacement fasteners. The adjustment means is comprised of a threaded post for varying the distance between hinge portions in the vertical therein raising or lowering the attached door/gate and horizontal threaded post having re-positional door/gate abutment that can be used to change the tilt of the door/gate by varying the length difference of the abutments between the spaced apart hinges.

2. Description of the Prior Art

There are other hinges designed for adjustment. While these hinges may be suitable for the purposes for which they where designed, they would not be as suitable for the purposes of the present invention as heretofore described.

It is thus desirable to provide a hinge comprising a top and bottom leaf portion that are respectively displaceable.

It is further desirable to print a hinge having a threaded post perpendicularly extending from one of said leaf portions having a rotatively mounted door/gate abutment thereon.

SUMMARY OF THE PRESENT INVENTION

A primary object of the present invention is to provide a hinge having a pair of displaceable portions whereby a door/gate having a pair of said hinges attached thereto provides means for varying the height of the attached door/gate as well as the tilt by varying the length of the horizontal door/gate abutment.

Another object of the present invention is to provide a hinge having a threaded post threadedly engaging a top and bottom leaf plate.

Yet another object of the present invention is to provide a hinge wherein one of said leaf plates has a ball bearing to reduce frictional wear.

Still yet another object of the present invention is to provide a hinge having a lubrication port whereby lubricant can be applied to said ball bearing.

Another object of the present invention is to provide a hinge wherein one of said leaf portions has a mounting plate fixedly attached thereto.

Yet another object of the present invention is to provide a hinge having a threaded post projecting substantially horizontal from the non-plate leaf portion Still yet another object of the present invention is to provide a hinge having a rotatively attached door/gate abutment that can be used to change the tilt of a door/gate having two of the instant invention's hinges spaced apart with the door/gate abutments displacements along said threaded post varies.

Additional objects of the present invention will appear as the description proceeds.

The present invention overcomes the shortcomings of the prior art by providing a hinge comprising door/gate horizontal and vertical displacement portions. The adjustment means is comprised of a threaded post for varying the distance between hinge portions in the vertical therein raising or lowering the attached door/gate and perpendicularly extending horizontal threaded post having re-positional door/gate abutment that can be used to change the tilt of the door/gate by varying the length difference of the abutments on the spaced apart hinges.

The foregoing and other objects and advantages will appear from the description to follow. In the description reference is made to the accompanying drawings, which forms a part hereof, and in which is shown by way of illustration specific embodiments in which the invention may be practiced. These embodiments will be described in sufficient detail to enable those skilled in the art to practice the invention, and it is to be understood that other embodiments may be utilized and that structural changes may be made without departing from the scope of the invention. In the accompanying drawings, like reference characters designate the same or similar parts throughout the several views.

The following detailed description is, therefore, not to be taken in a limiting sense, and the scope of the present invention is best defined by the appended claims.

BRIEF DESCRIPTION OF THE DRAWING FIGURES

Figure 2:
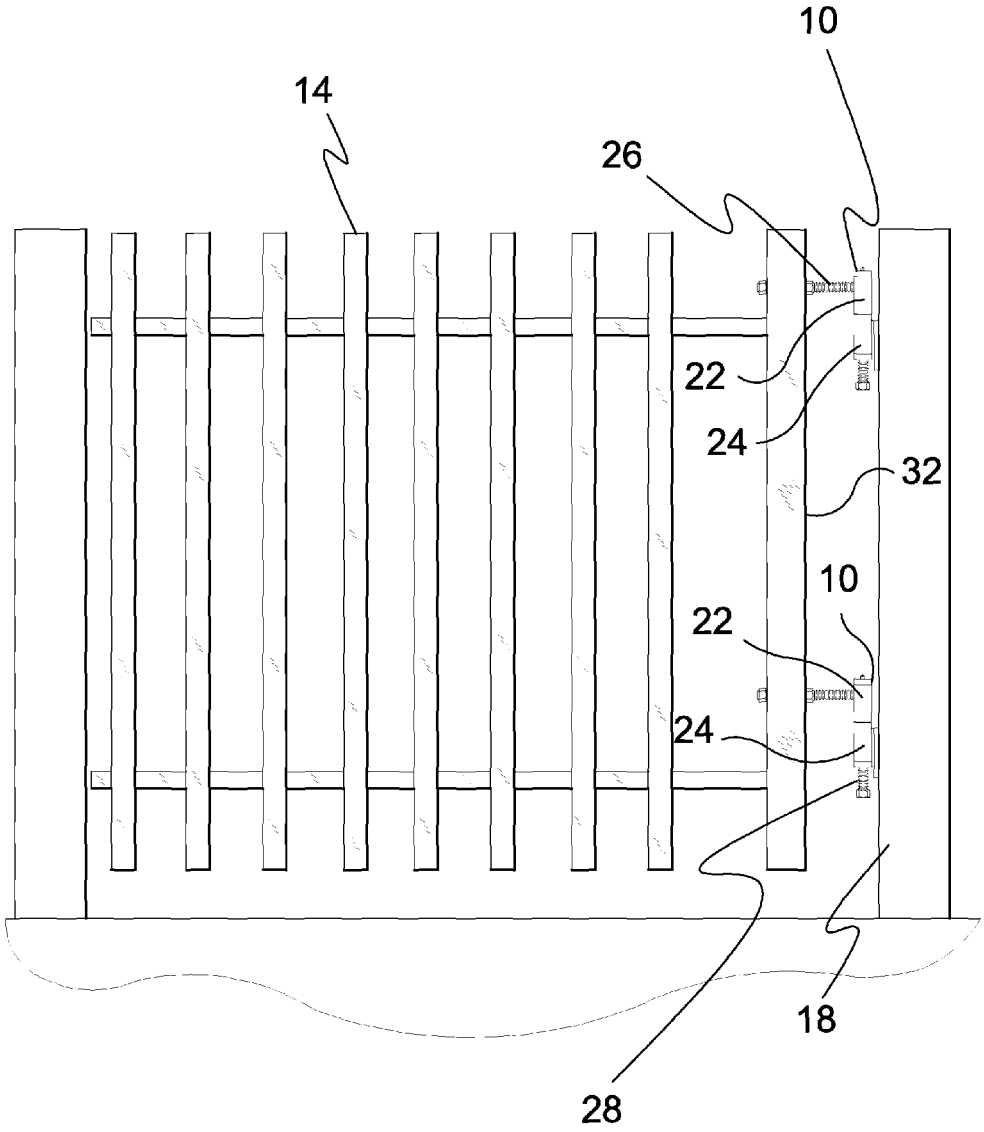
Figure 3:
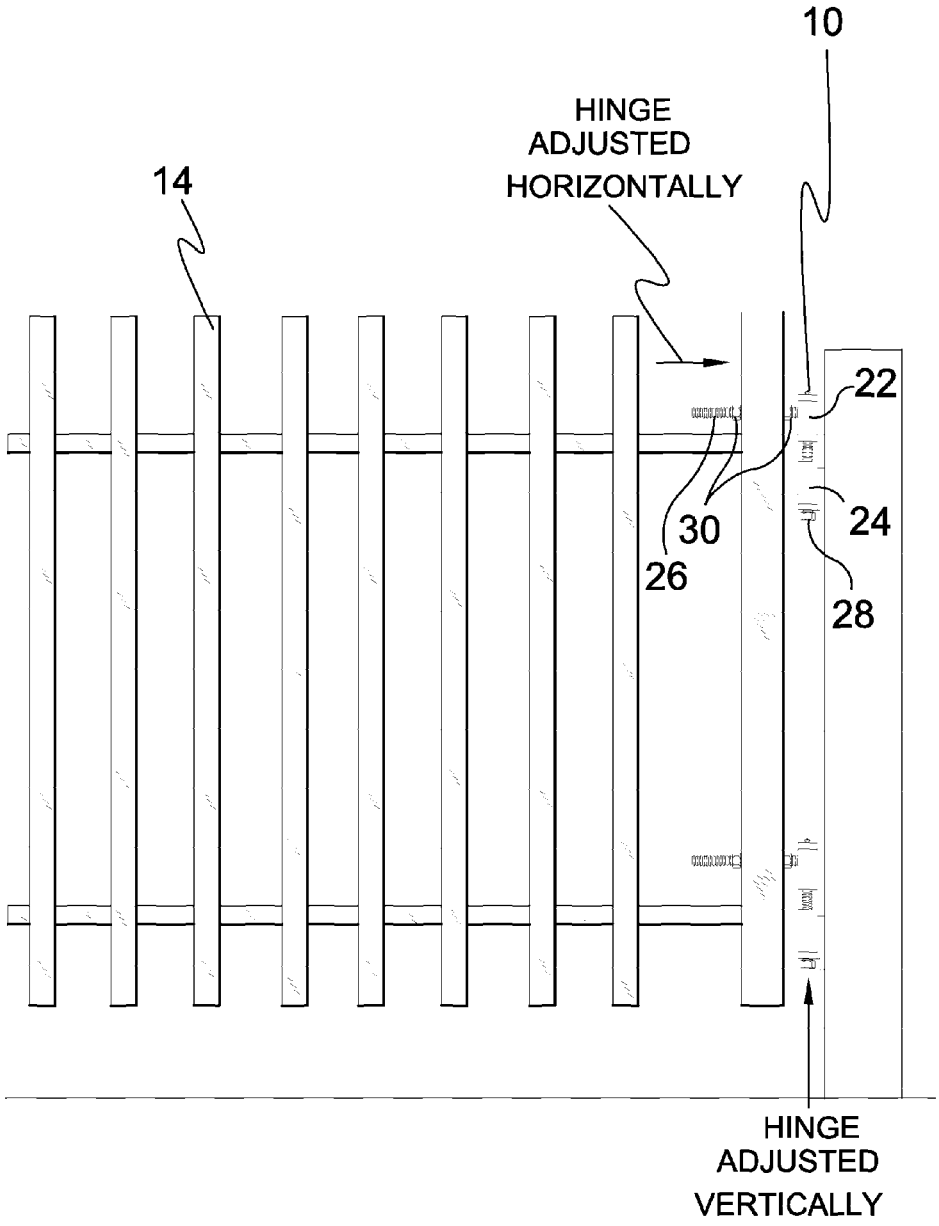
Figure 4:
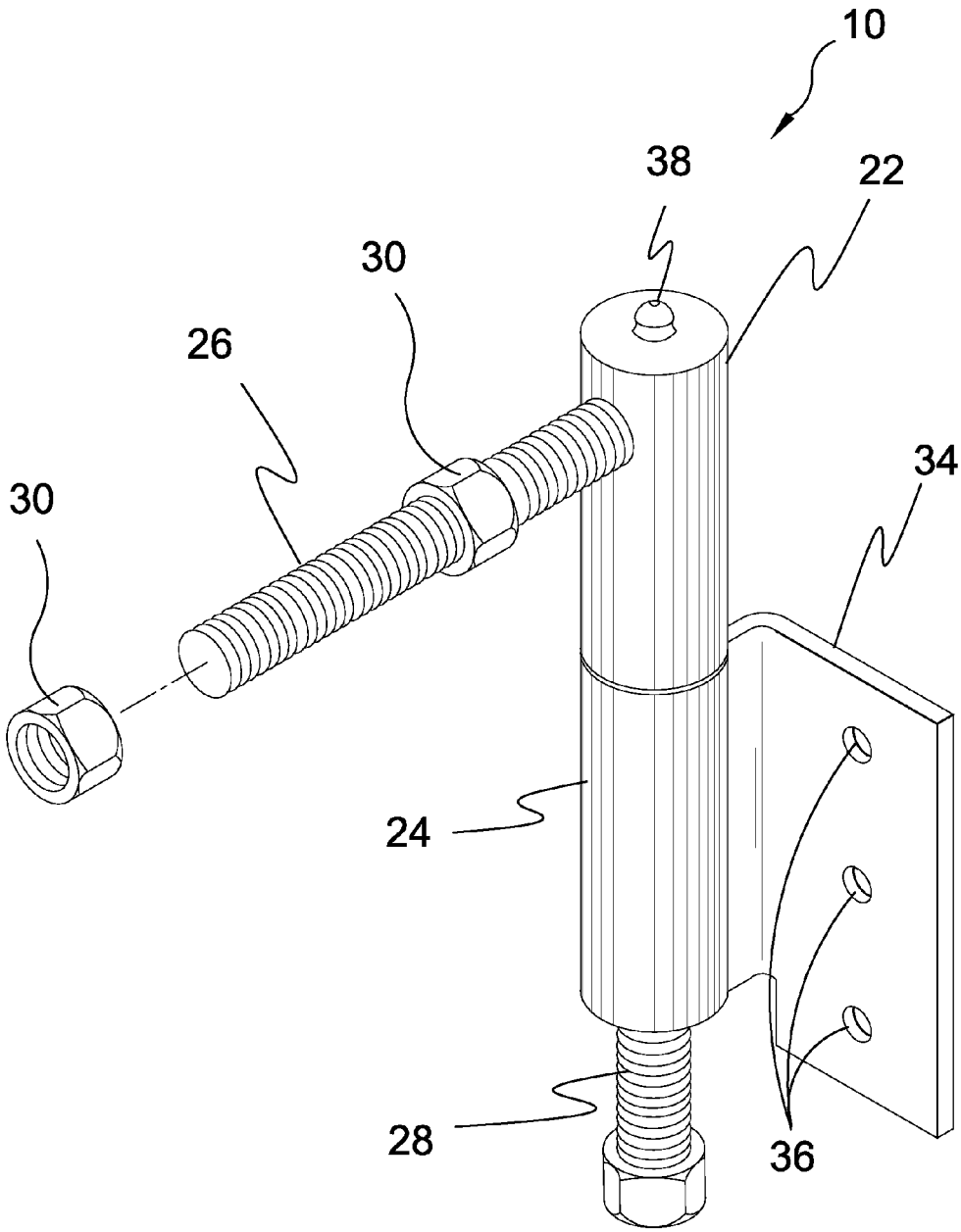
Figure 5:
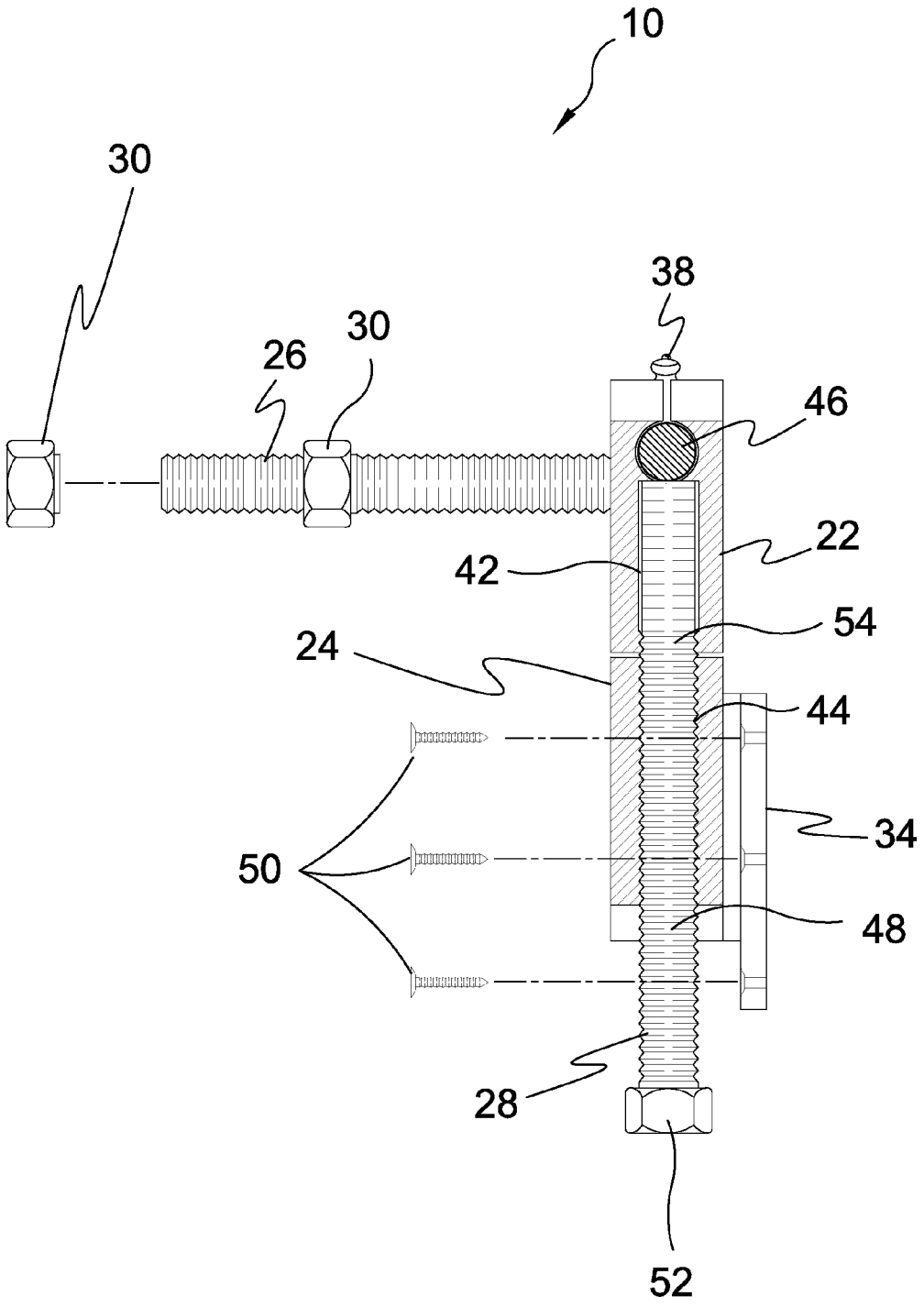
Figure 6:
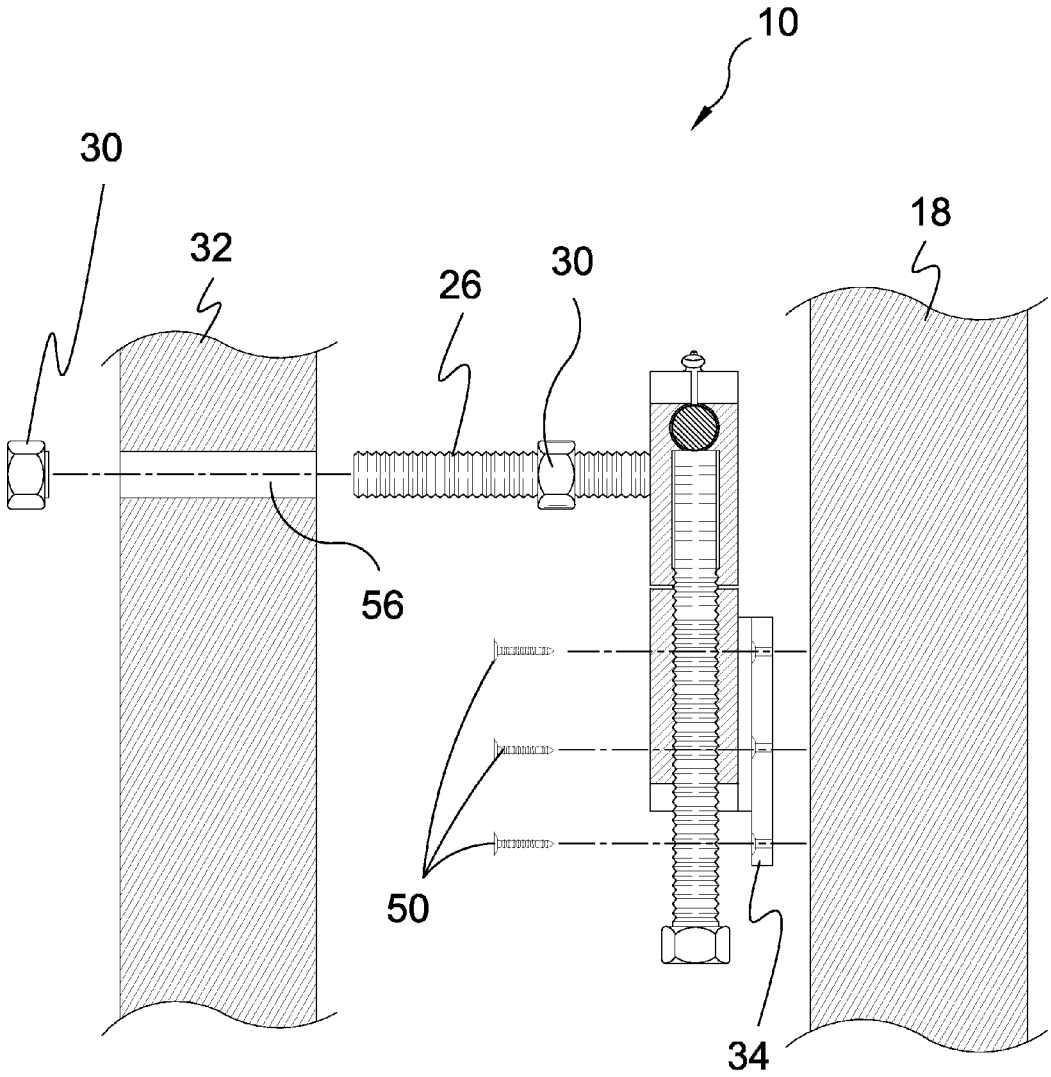
Figure 7:
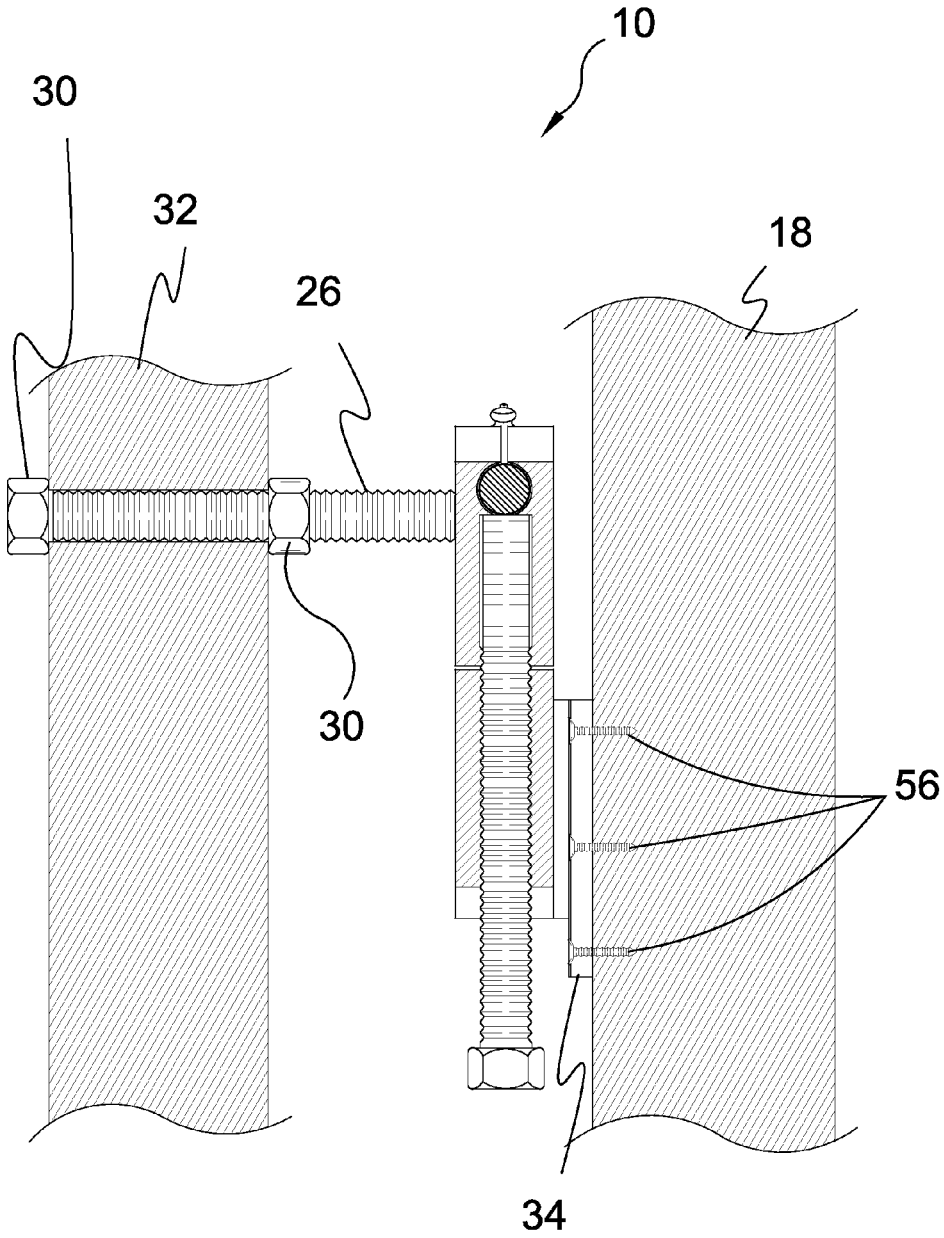
Figure 8:
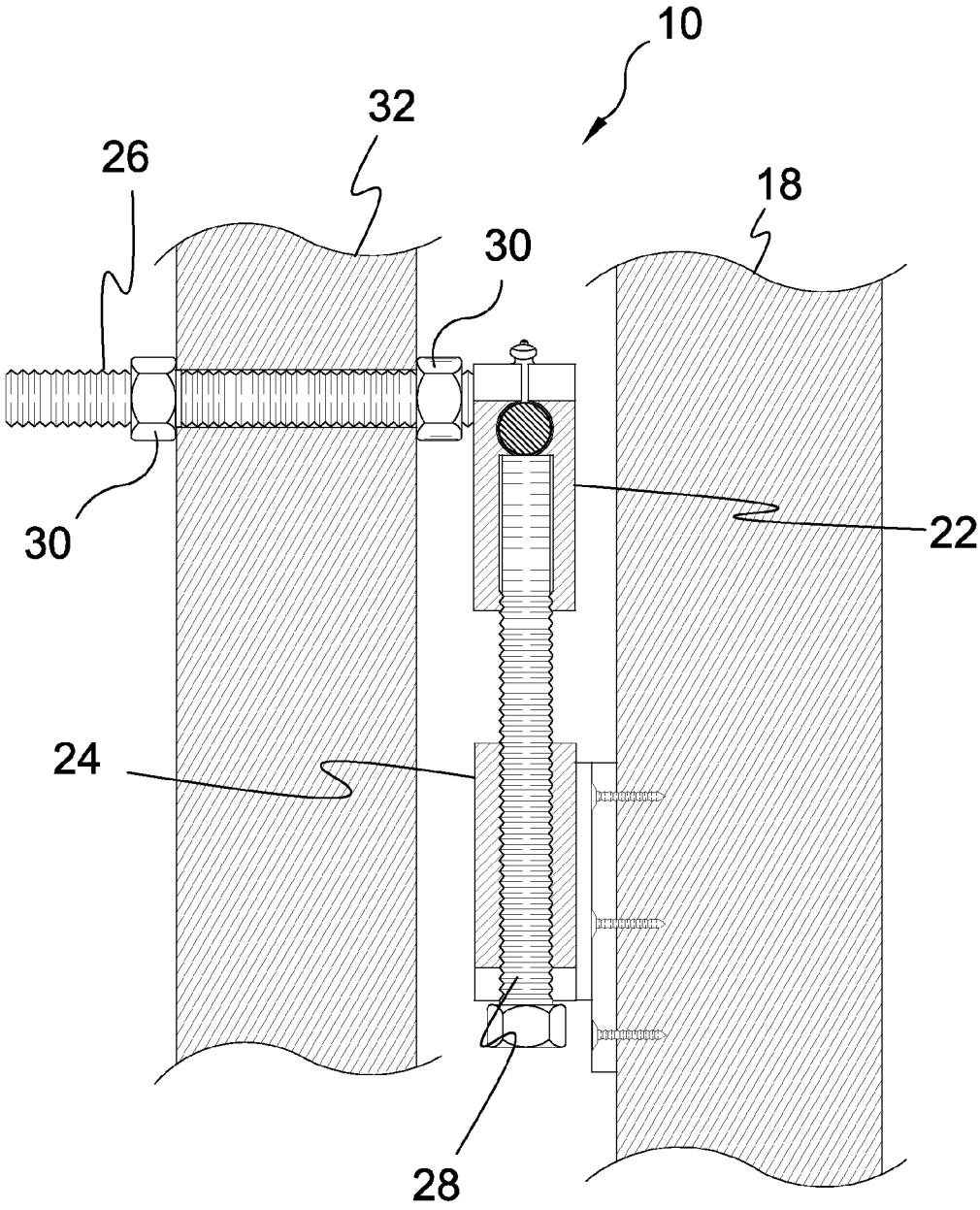

In order that the invention may be more fully understood, it will now be described, by way of example, with reference to the accompanying drawing in which:

FIG. 1 is an illustrative view of prior art.
FIG. 2 is an illustrative view of the present invention in use.
FIG. 3 is an illustrative view of the present invention in use.
FIG. 4 is a perspective view of the present invention.
FIG. 5 is a sectional view of the present invention.
FIG. 6 is a sectional view of the present invention.
FIG. 7 is a sectional view of the present invention.
FIG. 8 is a sectional view of the present invention.

DESCRIPTION OF THE REFERENCED NUMERALS

Turning now descriptively to the drawings, in which similar reference characters denote similar elements throughout the several views, the figures illustrate the Hinge Incorporating Vertical and Horizontal Adjustments of the present invention. With regard to the reference numerals used, the following numbering is used throughout the various drawing figures.

10 Hinge Incorporating Vertical and Horizontal Adjustments of the present invention
12 prior art
14 gate
16 jack
18 vertical column
20 hinge of 12
22 superior hinge section of 12
24 inferior hinge section of 12
26 horizontal threaded adjustment rod
28 vertical threaded adjustment bolt
30 adjustment nut
32 gate frame
34 mounting plate
36 hardware apertures
38 grease fitting
40 ball bearing
42 unthreaded through bore of 22
44 threaded through bore of 24
46 unthreaded portion of 28
48 threaded portion of 28
50 mounting hardware
52 bolt head
54 shaft of 28
56 mounting aperture of 32

DETAILED DESCRIPTION OF THE PREFERRED EMBODIMENT

The following discussion describes in detail one embodiment of the invention (and several variations of that embodiment). This discussion should not be construed, however, as limiting the invention to those particular embodiments, practitioners skilled in the art will recognize numerous other embodiments as well. For definition of the complete scope of the invention, the reader is directed to appended claims.

FIG. 1 is an illustrative view of prior art 12. When installing heavy gates 14 or doors, jacks 16 are required to hold them while leveling. getting them level and perfectly spaced between each other is very difficult because once the existing hinges 20 are welded or bolted to the vertical column 18 and the jacks 16 are removed, the gates or door often have a tendency to reposition and sag due to the weight resting solely on the pivots. The present invention overcomes this problem by providing a hinge design that gives full adjustment for full sized gates having vertical and horizontal adjustments with a ball bearing to minimize friction and wear.

FIG. 2 is an illustrative view of the present invention in use. The present invention provides an adjustable hinge 10 design that gives full adjustment along both the vertical and horizontal planes once installed on the vertical column 18 and the gate frame 32. The adjustable hinge 10 is provided in two sections with the pivot being a partially threaded vertical bolt 28 extending through the inferior hinge section 24 into the upper thus pivotally connecting the two sections. The upper portion of the superior hinge section 22 has a threaded rod 26 projecting therefrom for attachment to the gate 14.

FIG. 3 is an illustrative view of the present invention in use. Shown is the adjustable hinge 10 adjusted horizontally and upward vertically to compensate for sagging of the gate 14. The horizontal threaded rods 36 are inserted through a pair of spaced apart mounting apertures disposed in the gate frame 32 and have a pair of adjustable nuts 30 sandwiching the frame to secure it thereto.

FIG. 4 is a perspective view of the present invention. Shown is a perspective view of the adjustable hinge 10 wherein the inferior hinge section 24 comprises a mounting plate 34 with hardware apertures 36 for mounting to a vertical column and a central threaded throughbore for receiving the vertical bolt 28 and providing access thereof into a corresponding unthreaded throughbore disposed in the superior hinge section 22 to provide a pivot therebetween. A grease fitting 38 is disposed on the top portion of the superior hinge section 22 to lubricate the interior components thereof. Also depicted is the horizontal rod projecting perpendicularly from a top portion of the superior hinge section 22 and its related adjustment nuts 30.

FIG. 5 is a sectional view of the present invention. Shown is the adjustable hinge 10 wherein the vertical bolt 28 has a shaft 54 a threaded portion 48 extending from the bolt head 52 and an unthreaded portion 46 on the distal end thereof. The inferior hinge section 25 has a threaded throughbore 44 into which the bolt 28 is threaded and the superior hinge section 22 has an unthreaded throughbore 42 beginning at its bottom end and terminating near the top for receiving the unthreaded shaft portion 46. A grease fitting 38 on top of the superior hinge section 22 feeds lubricant to a ball bearing 46 positioned within the terminus end of the unthreaded throughbore 42 to minimize friction and wear. Also shown is the mounting plate 34 and related hardware 50 along with the horizontal rod 26 and adjustment nuts 30.

FIG. 6 is a sectional view of the present invention. Shown is a sectional view of the adjustable hinge 10 and all components about to be installed to a gate and vertical column 18. The mounting plate 34 is to be fastened to the vertical column 18 with appropriate mounting hardware 50 and the horizontal rod 26 is ready to be placed into the mounting aperture 56 of the gate frame 32 to be secured by the adjustment nuts 30.

FIG. 7 is a sectional view of the present invention. Shown is a sectional view of the adjustable hinge 10 and all components installed to a gate and vertical column 18. The mounting plate 34 is fastened to the vertical column 18 with appropriate mounting hardware 50 and the horizontal rod 26 is placed into the mounting aperture 56 of the gate frame 32 secured by the adjustment nuts 30.

FIG. 8 is a sectional view of the present invention. Shown is a sectional view of the adjustable hinge 10 with the vertical adjustment bolt 28 turned to advance it upward and thereby create separation between the inferior hinge section 24 and the superior hinge section 26 thus raising the gate frame 32 and gate. The horizontal adjustment rod 26 has been pulled tighter to the column 30 by adjusting the nuts 30 on the horizontal rod 26.

It will be understood that each of the elements described above, or two or more together may also find a useful application in other types of methods differing from the type described above.

While certain novel features of this invention have been shown and described and are pointed out in the annexed claims, it is not intended to be limited to the details above, since it will be understood that various omissions, modifications, substitutions and changes in the forms and details of the device illustrated and in its operation can be made by those skilled in the art without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims:

1. A hinge incorporating vertical and horizontal adjustments comprising:

a) upper and lower hinges each having two independent substantially cylindrical sections including an superior hinge section and a inferior hinge section with each having a centrally disposed through bore;

b) a substantially threaded vertical bolt that is inserted through the bottom of said through bore of said inferior hinge section and into said through bore of said superior hinge section to provide a pivot for the two sections and to adjust separation between the superior and inferior hinge sections for each hinge;

c) a mounting plate for mounting each said inferior hinge section to a vertical column; and d) a threaded horizontal adjustment rod projecting perpendicular from an upper portion of each said superior hinge section for securing a gate frame thereto whereby height and tilt of said gate may be adjusted by adjustment of each said vertical bolt and horizontal adjustment rod.

2. The hinge incorporating vertical and horizontal adjustments according to claim 1, wherein said vertical bolt has a shaft that is threaded from an area proximal to the bolt head and has a length greater than that of the through bore of said inferior hinge section and a smooth, unthreaded distal end for insertion into said through bore of said superior hinge section.

3. The hinge incorporating vertical and horizontal adjustments according to claim 2, wherein said through bore of said inferior hinge section is interiorly threaded and the interior of said though bore of said superior hinge has a substantially closed top and is smooth and unthreaded.

4. The hinge incorporating vertical and horizontal adjustments according to claim 3, wherein said vertical bolt is threadable into said threaded through bore until the ends of the threads thereof are significantly flush with the top of said inferior hinge section and the unthreaded portion of said shaft is fully within said unthreaded through bore of said superior section.

5. The hinge incorporating vertical and horizontal adjustments according to claim 4, wherein said mounting plate is adapted to be mounted to a vertical column utilizing mounting hardware to secure said hinge thereto.

6. The hinge incorporating vertical and horizontal adjustments according to claim 3, wherein said superior hinge section further comprises a means for lubricating said unthreaded portion of said shaft within said unthreaded throughbore to reduce friction and wear during the movement thereof.

7. The hinge incorporating vertical and horizontal adjustments according to claim 6, wherein said lubricating means is a grease fitting externally disposed on said top portion of said superior hinge section in distribution communication with a ball bearing disposed therein.

8. The hinge incorporating vertical and horizontal adjustments according to claim 7, wherein vertical adjustment may be accomplished by rotating said vertical bolt to advance it through said threaded through bore of said superior hinge section while said unthreaded portion of said bolt shaft rotates freely within said unthreaded through bore and the entire superior section is urge upward by the advancement of said bolt.

9. The hinge incorporating vertical and horizontal adjustments according to claim 8, wherein the unthreaded marriage of said unthreaded portion of said shaft and said unthreaded through bore enable the free-swinging, pivoting movement of said superior hinge section, the horizontal rod and associated gate.

10. The hinge incorporating vertical and horizontal adjustments according to claim 8, wherein said horizontal adjustments and vertical adjustments are usable in concert to establish precise, durable positioning of said gate.

11. The hinge incorporating vertical and horizontal adjustments according to claim 7, wherein rotation of the distal end of said shaft contacts said ball bearing in turn rotating it and drawing grease from said grease fitting for gravity fed distribution to the surfaces therein.

12. The hinge incorporating vertical and horizontal adjustments according to claim 1, wherein said horizontal adjustment rod is integral with said superior hinge section and includes at least two adjustment nuts therewith.

13. The hinge incorporating vertical and horizontal adjustments according to claim 12, wherein during installation at least one said adjustment nut is positionable thereon proximal the hinge and the other at least one adjustment nut is temporarily removable.

14. The hinge incorporating vertical and horizontal adjustments according to claim 13, wherein the distal end of said horizontal rod is adapted to be inserted through a mounting aperture disposed in the gate frame and pass therethrough and once in place the adjustment nuts nearest said gate frame and may be tightened thereagainst to retain it in position.

15. The hinge incorporating vertical and horizontal adjustments according to claim 14, wherein said horizontal adjustment may be utilized to pull or push said gate accordingly to compensate for tilting or sagging and maintaining a level condition.

16. The hinge incorporating vertical and horizontal adjustments according to claim 15, wherein a second adjustment nut may be employed with the first nuts by tightening thereagainst thus acting as lock nuts to prevent the casual displacement thereof due to the movement and vibrations inherent during usage.

* * * * *